US007451496B2

(12) United States Patent
Carey et al.

(10) Patent No.: US 7,451,496 B2
(45) Date of Patent: Nov. 18, 2008

(54) GLOVE WITH FLOW-THROUGH POCKET

(75) Inventors: Michael J. Carey, San Diego, CA (US); Joseph H. Edwards, Salt Lake City, UT (US)

(73) Assignee: Seirus Innovative Accessories, Inc., Poway, CA (US)

( * ) Notice: Subject to any disclaimer, the term of this patent is extended or adjusted under 35 U.S.C. 154(b) by 125 days.

(21) Appl. No.: 11/342,075

(22) Filed: Jan. 27, 2006

(65) Prior Publication Data

US 2006/0162045 A1 Jul. 27, 2006

Related U.S. Application Data

(63) Continuation-in-part of application No. 10/314,029, filed on Dec. 6, 2002, now Pat. No. 7,086,093.

(60) Provisional application No. 60/338,103, filed on Dec. 7, 2001.

(51) Int. Cl.
*A41D 19/00* (2006.01)

(52) U.S. Cl. ..... 2/160; 2/161.1; 2/164

(58) Field of Classification Search ..... 2/159, 2/160, 247, 249, 250, 251, 252, 253, 20
See application file for complete search history.

(56) References Cited

U.S. PATENT DOCUMENTS 1,970,081 A 8/1934 Eisendrath
2,510,720 A 6/1950 Siegel
4,535,482 A * 8/1985 Spector et al. ..... 2/160
4,543,671 A 10/1985 Monkk
4,559,646 A * 12/1985 Ertl ..... 2/16
4,615,049 A 10/1986 Samelian
4,662,006 A 5/1987 Ross, Jr.
4,742,579 A 5/1988 Dunford
4,805,242 A * 2/1989 Bolton ..... 2/160
4,933,992 A * 6/1990 Kallman ..... 2/160
5,517,693 A * 5/1996 Noonan ..... 2/159
5,722,482 A * 3/1998 Buckley ..... 165/10
6,141,801 A * 11/2000 Helenick ..... 2/159
7,086,093 B2 * 8/2006 Carey et al. ..... 2/159

OTHER PUBLICATIONS

Seirus Innovation Inc., 2000 Seirus Innovation Inc. catalog, cover and back page, p. 3 showing "Childsplay Mitt," Seirus Innovation Inc., Poway, California, U.S.A.

* cited by examiner

*Primary Examiner*—Katherine Moran
*Assistant Examiner*—Sally C Cline
(74) *Attorney, Agent, or Firm*—Holme Roberts & Owen LLP

(57) ABSTRACT

A glove having a heat insulating barrier is disclosed. The heat insulating barrier is removably inserted into a zippered pocket or a weblike pouch, the pocket or pouch being positioned proximate the back of a user's hand. the heat insulating barrier acts to selectively reduce heat conduction from the back side of the hand, thereby allowing the user's hand or hands to remain warm in cold environments. The ability to stack a varying number of heat insulating layers in the pouch or pocket further allows the user to selectively control the warmth of the hand as the ambient temperature fluctuates during use. The zippered pocket or weblike pouch can have first and second opening to permit increased cooling through the back portion of the glove.

20 Claims, 7 Drawing Sheets

GLOVE WITH FLOW-THROUGH POCKET

CROSS-REFERENCE TO RELATED APPLICATIONS

This application is a continuation-in-part of application Ser. No. 10/314,029, filed Dec. 6, 2002 now U.S. Pat. No. 7,086,093, which claims the benefit of Provisional Application No. 60/338,103, filed Dec. 7, 2001, both of which are incorporated herein by reference in their entireties.

BACKGROUND OF THE INVENTION

1. Field of the Invention

The invention is directed to the field of apparel and, more particularly, to cold-weather hand coverings like a glove having a selectively shaped insulating barrier that is removably placed into the hand coverings to selectively control heat conduction from the hand coverings.

2. Description of the Prior Art

It is known in the prior art to provide pouch-like pockets on the surface of gloves or mittens to provide an external source of heat for warming the hand in cold weather environments. Such prior art devices are disclosed, for example, in U.S. Pat. No. 1,970,081 (Eisendrath), in U.S. Pat. No. 4,543,671 (Monk) and in U.S. Pat. No. 4,742,579 (Dunford). Such devices, however, require periodic replenishment of the fuel or power for the external source of heat.

The glove disclosed herein obviates the need for replenishment of the fuel or power for the external heat source by employing a heat-insulating barrier—instead of a heat source—having thermal characteristics that are tailored to substantially reduce the conduction of heat away from the back side of the hand.

SUMMARY OF THE INVENTION

A glove having an insulation pocket for removable insertion of an insulating barrier is disclosed. The glove has finger portions, a thumb portion, a palm portion, a back-hand portion and a wrist portion. A first embodiment of the glove has a zippered-pocket positioned proximate the back-hand portion of the glove for removable insertion of a heat-insulating barrier. The heat insulating barrier has a first heat-insulating layer and a second heat-insulating layer that act as barriers to heat conduction from the back side of the hand.

A second embodiment of the glove has a web-like pouch that is secured to the back-hand portion of the glove for removable insertion of a similar heat-insulating barrier. Alternative embodiments of the heat-insulating barrier are contemplated and include barriers constructed of single layers rather than multiple layers and multiple barriers that are made from individual barriers that are stacked in layers, one upon the other. The ability to add and remove any number of barriers enables one to convert an otherwise cold weather glove, typically used in the cold months of winter, into a moderate weather glove that can also be used in the months of spring, thereby obviating the need to purchase or otherwise carry two sets of gloves for use in different temperature environments. A still further embodiment includes a heat-generating layer positioned adjacent the heat-insulating barrier or positioned in between any two individual heat-insulating barriers that are stacked in layers.

Another embodiment of the invention is a glove having an insulation pocket for removable insertion of an insulator. The glove includes: a glove body having a back-hand portion formed from a first material; an insulator for insulating the back of the hand, said insulator being formed from a heat-insulating material; and pocket means formed relative to said back-hand portion for receiving said insulator. The pocket means has: a first opening for removably positioning said insulator therein, said pocket means including a pouch formed from a second material different than said first material, said pouch being secured to said glove body and sized to receive said insulator; and a second opening, wherein opening said first opening and said second opening and removing said insulator permits increased cooling from the back of the hand.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
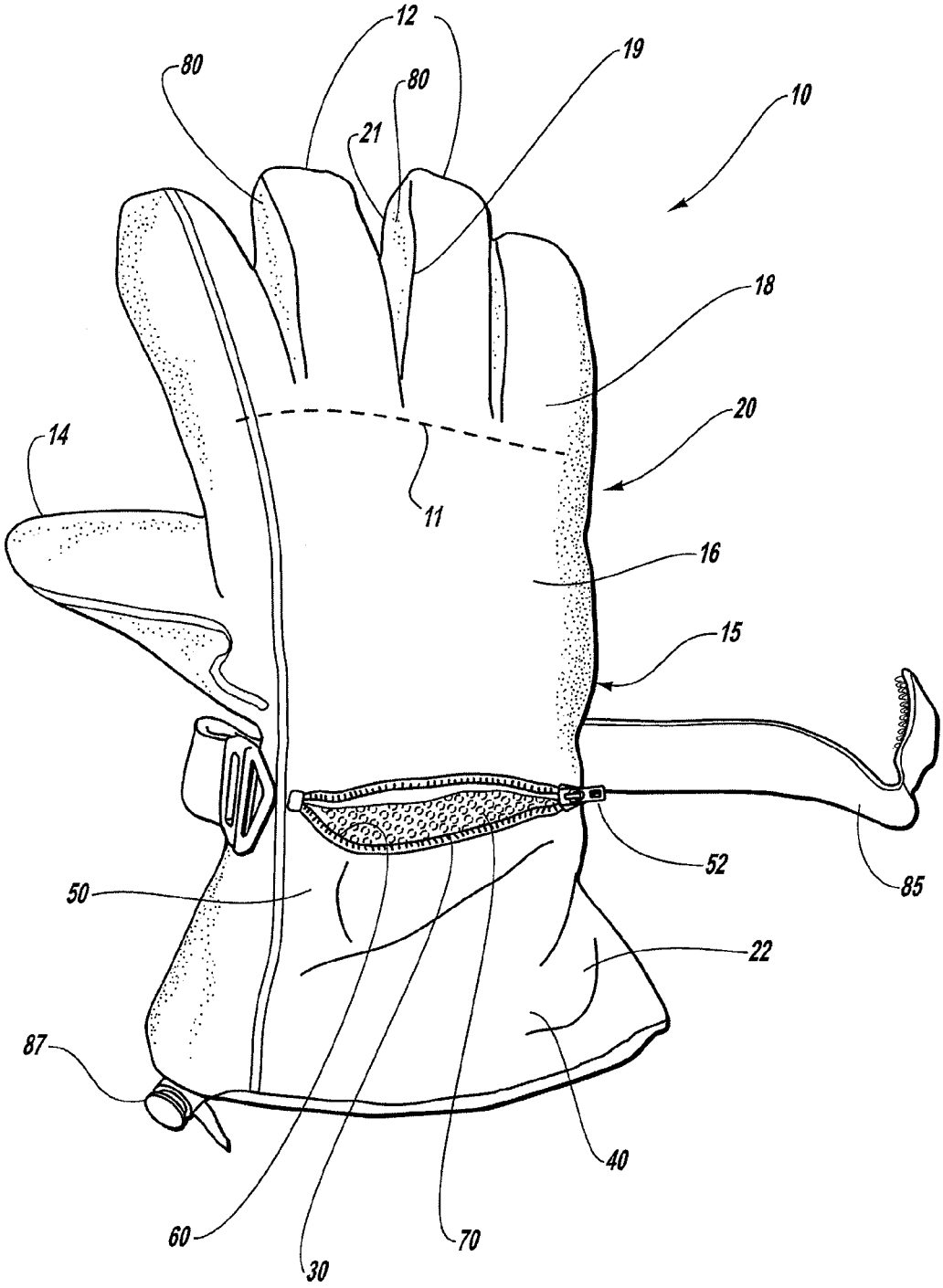
FIG. 1 is a top view of a first embodiment of the present invention, showing the upper surface of a glove having a zippered pouch means for removable insertion of a heat-insulating barrier.
Figure 3:
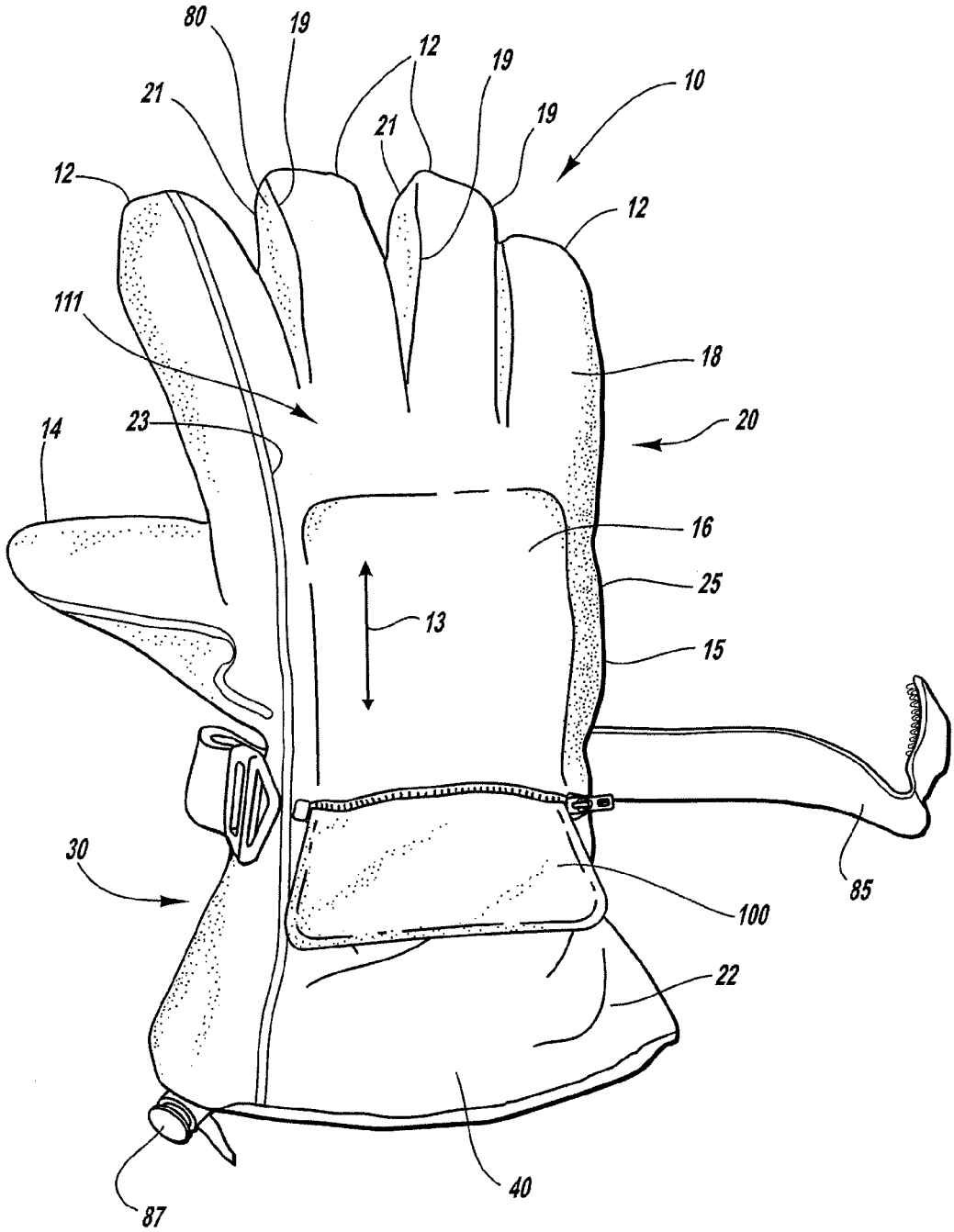
FIG. 3 is a view of the embodiment illustrated in FIG. 1 whereby the heat-insulating barrier is partially inserted or removed from the pouch means.

Referring to FIGS. 1 and 3, a glove 10 is provided that is configured to fit a human hand. The glove 10 has, generally, fingers, a thumb 14, a palm portion 15, a back-hand portion 16 and a wrist portion 22. A heat-insulating barrier 100 is removably inserted into a pouch means 50 that is secured to the back-hand portion 16 of the glove 10. The heat-insulating barrier 100 is secured specifically to the back-hand portion 16 of the glove 10 as it is believed that heat loss from the backside of the hand is responsible for the fingers becoming cold in cold weather environments. For example, it is believed that heat is lost through the back of the hand while the hand grips a ski pole when skiing.

The heat-insulating barrier 100 is constructed of heat-insulating material, such as, for example, closed-cell neoprene with fleece laminated therewith, and is adapted for insertion into the pouch means 50 when the fingers of the hand are cold and for removal from the pouch means 50 when the fingers of the hand are warm or are otherwise comfortable. When the heat-insulating barrier 100 is removed from the glove 10, it may simply be placed in a pocket of the user. The heat-insulating barrier 100 thus enables one to convert an otherwise cold weather glove, typically used in the cold months of winter, into a moderate weather glove that can also be used in the months of spring, thereby obviating the need to purchase or otherwise carry two sets of gloves for use in different temperature environments.

Figure 2:
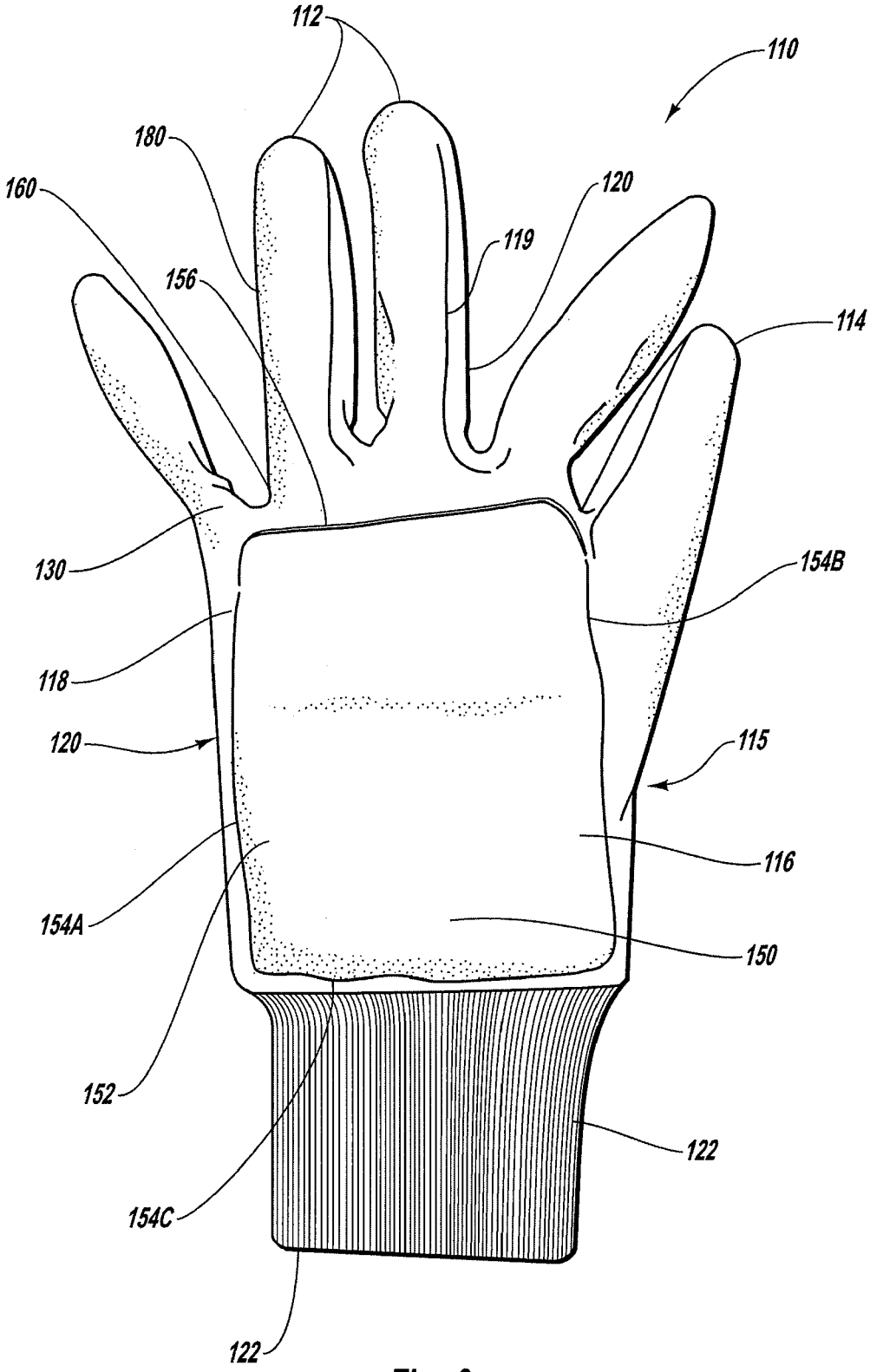
FIG. 2 is a top view of a second embodiment of the present invention, showing the upper surface of a glove having a web-like pouch means for removable insertion of a heat-insulating barrier.
Figure 4:
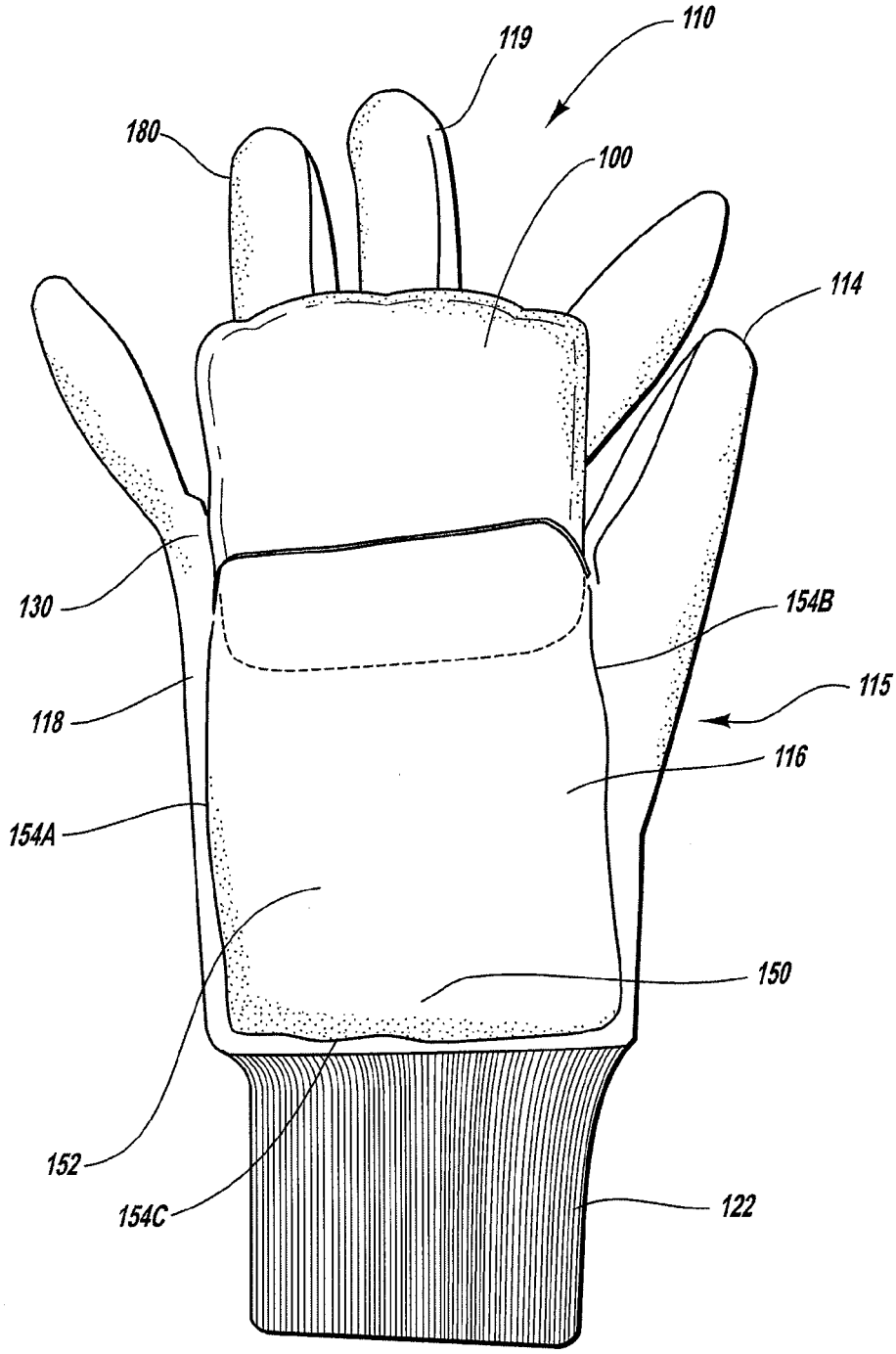
FIG. 4 is a view of the embodiment illustrated in FIG. 2 whereby the heat-insulating barrier is partially inserted or removed from the web-like pouch means.

Referring to FIGS. 2 and 4, another glove 110 is provided that is configured to fit a human hand. The glove 110 has, generally, fingers 112, a thumb 114, a palm portion 115, a back-hand portion 116 and a wrist portion 122. The heat-insulating barrier 100 is removably inserted into a pouch means 150 that is secured to the back-hand portion 116 of the glove 110. The heat-insulating barrier 100 is secured specifically to the back-hand portion 116 of the glove 110.

The heat-insulating barrier 100 is adapted for insertion into the pouch means 150 when the fingers of the hand are cold and for removal from the pouch means 150 when the user desires such as when the fingers of the hand are warm or are otherwise comfortable.

Beneficially, the heat-insulating barrier 100 does not require a power source, such as that provided through a battery or through chemical reaction, to provide heat. Rather, the heat insulating barrier 100 keeps the fingers of the hand warm by providing an extra layer, or layers, of insulation, such that the heat of the hand may be constrained from being conducted and convected to the cold air that surrounds the glove 10 (110). Various embodiments of the heat-insulating barrier are contemplated, depending on the environment in which the glove 10 (110) is to be used. A preferred embodiment of the heat-insulating barrier 100, for example, has a first heat-insulating layer 101 and a second heat-insulating layer 102. The first and second heat-insulating layers 101, 102 are joined to one another using any suitable means, such as glue or sewing thread. Alternatively, the heat-insulating barrier 100 may comprise a single heat-insulating layer or a plurality of heat-insulating layers. Alternatively still, multiple heat-insulating barriers 100 may be stacked, one upon the other, to provide the desired thermal characteristics (i.e., the desired barrier to heat conduction). In other words, more than one single heat-insulating barrier 100 may be placed into the pouch means 50 and 150, depending on the temperature and the comfort level of the user. For extreme conditions or cold-sensitive hands, one or more heat-generating layers may be used in conjunction with the heat insulating barrier or barriers.

Referring now to the first embodiment, as illustrated in FIG. 1, the fingers 12, thumb 14, the palm portion 15 and back-hand portion 16 and the wrist portion 22 are constructed from heat-insulating and water resistant materials that comprise the upper surface 18 and the lower surface 20 of the glove 10. For example, the first embodiment of the glove 10 has an upper surface 18 that is comprised of an inner layer 30 and an outer layer 40. The outer layer 40 is preferably constructed from a water resistant material while the inner layer 30 is constructed of a heat-insulating material. In a similar fashion, the glove 10 has a lower surface 20 that is constructed of an inner layer (not referenced) and an outer layer (not referenced). The outer layer of the lower surface 20 is also, preferably, constructed of a water resistant material and may have a roughened surface texture to facilitate the grasping of objects in a snowy or otherwise cold and wet environment. The inner layer of the lower surface 20 is preferably constructed using a heat-insulating material.

Referring still to FIG. 1, the pouch means 50 is constructed such that a zipper 52 is secured to an opening 60 that is cut into the outer layer 40 of the upper surface 18. The zipper 52 is illustrated as extending laterally across the glove 10 proximate the wrist portion 22, although the zipper could just as readily be configured to extend laterally across the glove 10 proximate the base 11 of the finger portions 12. Although not illustrated, it is further contemplated that the zipper may extend longitudinally 13 along the back-hand portion 16 of the glove 10, with one end of the zipper starting proximate the wrist portion 22 of the glove 10 and the other end of the zipper terminating proximate the base 11 of the finger portions 12 of the glove 10. Preferably, the longitudinally extending zipper (not shown) will be positioned on one side of the back-hand portion 16 of the glove 10—i.e., the thumb side 23 or the little finger side 25.

The opening 60 provides access to the space of the glove 10 between the inner layer 30 and the outer layer 40. The space extends the length and width of the back-hand portion 16. A perforated pouch 70 extends into the opening 60 and also covers the back-hand portion 16 of the glove 10. The perforated pouch 70 is sized and shaped to receive the heat-insulating barrier 100. When the heat-insulating barrier 100 is fully inserted into the glove 10, the perforated pouch 70 will restrain the barrier 100 from movement between the inner layer 30 and the outer layer 40 and, thereby, ensure that the barrier 100 will remain positioned about the back-hand portion 16 of the glove 10. The pouch 70 enables easy insertion and removal of the heat-insulating barrier 100 which, in turn, enables quick and efficient conversion between configuration for cold and warmer (or not so cold) conditions simply by adding or removing barriers 100 as needed. A plurality of barriers 100 may be easily carried by a user—e.g., in the user's pocket—to enable conversion between cold and less cold environments as the day progresses from morning to night. If desired, one or more heat-generating layers may be positioned adjacent any one or more of the heat insulating barriers 100 in the pocket 70.

Figure 5:
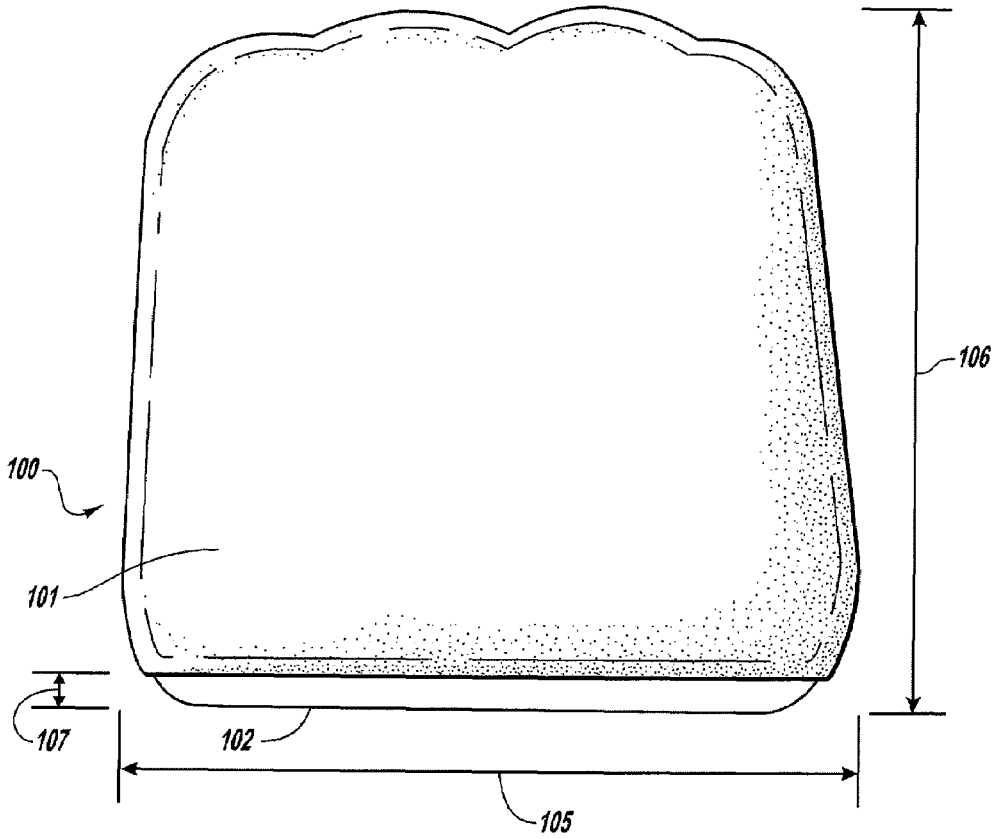
FIG. 5 is a top side view of a heat-insulating barrier used in the embodiments of FIGS. 1 and 2.

Various sizes and shapes of the perforated pouch 70 are contemplated to coincide with various sizes and shapes of the heat-insulating barrier 100. For example, a heat-insulating barrier 100 having a width 105 (see FIG. 5) from about three inches to about four inches, a length 106 from about three inches to about five inches and a thickness 107 from about one-sixteenth of an inch to about one-fourth of an inch are contemplated, with preferable dimensions having a width 105, length 106 and thickness 107 equal to about three and one-half inches, about four inches and about one-eight of an inch, respectively. Referring to FIG. 3, a heat-insulating barrier 100 having the above preferred dimensions is illustrated being partially inserted into the perforated pouch 70.

Both the upper surface layer 18 and the lower surface layer 20 of the glove 10 have peripheries 19, 21 that are cut into the pattern for a human hand. Thus, the glove 10 may be fashioned by securing the upper surface layer 18 to the lower surface layer 20 at the peripheries 19, 21 using any means, such as, for example, by sewing. Further, side panels 80 may be positioned between the upper surface layer 18 and the lower surface layer 20 to form the fingers 12 as shown and provide the glove 10 with a better fit to the fingers of the hand. In a similar fashion, the thumb portion 14 may be constructed independently of the upper surface layer 18 and the lower surface layer 20 and secured independently to, for example, the lower surface layers to provide a better fit for the thumb of the hand. And as is well-known in the art, a strap 85 and a wrist cinch 87 may be secured to the glove 10 to provide the glove 10 with a secure and snow-tight fit about the wrist of an user.

A second embodiment of the glove 110 illustrated in FIG. 2 has an upper surface 118 and a lower surface 120 that are both constructed from a single layer 130. The single layer 130 is preferably constructed from a light-weight, heat-insulating material, such that the glove 110 may be used, for example, as a liner to an outer glove shell (not illustrated). Alternatively, the glove 110 may be used in a cold environment where finger dexterity is required.

Referring still to FIG. 2, the pouch means 150 is constructed such that a flexible, web-like material forms a web-like pouch 152 that is secured to the upper surface 118 of the glove 110. The web-like pouch 152 extends substantially over the back-hand portion 116 of the glove 110 and has a first peripheral portion 154 (A-C) and a second peripheral portion 156. The first peripheral portion 154 (A-C) is secured to the upper surface 118 of the glove 110 through any suitable means, such as, for example, by sewing. The second peripheral portion 156 is left unsecured and provides an opening 160 through which the heat-insulating barrier 100 may be removably inserted. The first peripheral portion 154 and the second peripheral portion 156 are sized and shaped so that the heat-insulating barrier 100 is securely positioned over the back-hand portion 116 of the glove 110. When the heat-insulating barrier 100 is fully inserted into the glove 110, the web-like pouch 152 will restrain the barrier 100 from movement over the upper surface 118 of the glove 110 and, thereby, ensure that the heat-insulating barrier 100 will remain positioned in the back-hand portion 116 of the glove 110.

Various sizes and shapes of the peripheral portions 154 (A-C), 156 are contemplated to coincide with various sizes and shapes of the heat-insulating barrier 100. For example, a heat-insulating barrier 100 having a width 105 from about three inches to about four inches, a length 106 from about three inches to about five inches and a thickness 107 from about one-sixteenth of an inch to about one-fourth of an inch are contemplated, with preferable dimensions having a width 105, length 106 and thickness 107 equal to about three and one-half inches, about four inches and about one-eight of an inch, respectively. Referring to FIG. 4, a heat-insulating barrier 100 having the above preferred dimensions is illustrated being partially inserted into the web-like pouch 152.

The single-layers 130 of the upper surface 118 and the lower surface 120 of the glove 110 have a peripheries 119, 121 that are cut into the shape of a human hand. Thus, the glove 110 may be fashioned by securing the single layers 130 of the upper surface 118 and the lower surface 120 at the peripheries 119, 121 using any traditional means, such as, for example, by sewing. Further, side panels 180 may be incorporated into the finger portions 112 between the single-layers 130 of the upper surface 118 and the lower surface 120 of the glove 110 to provide the glove 110 with a better fit to the fingers of the hand. In a similar fashion, the thumb portion 114 may be constructed independently of the single-layers 130 of the upper surface 118 and the lower surface 120 of the glove 110 and secured independently to, for example, the lower surface 120 to provide a better fit for the thumb of the hand. A tightly knit wrist portion 122 is sewn onto the glove 110 proximate the palm portion 115 and the back-hand portion 116 to give the glove 110 a tight fit about the wrist of a user.

Figure 6:
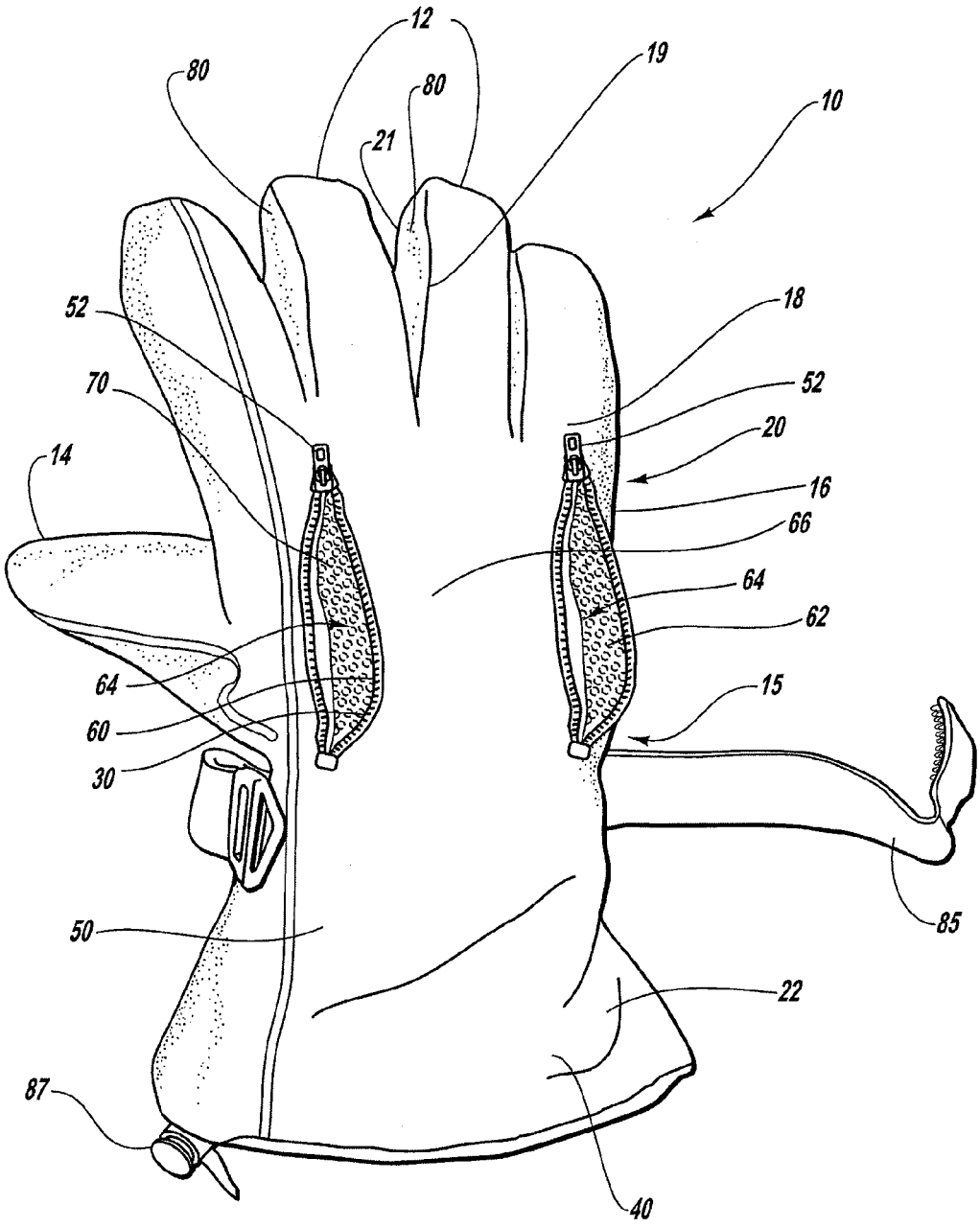
FIG. 6 is a perspective top view of an alternate configuration of a glove of the present invention.
Figure 7:
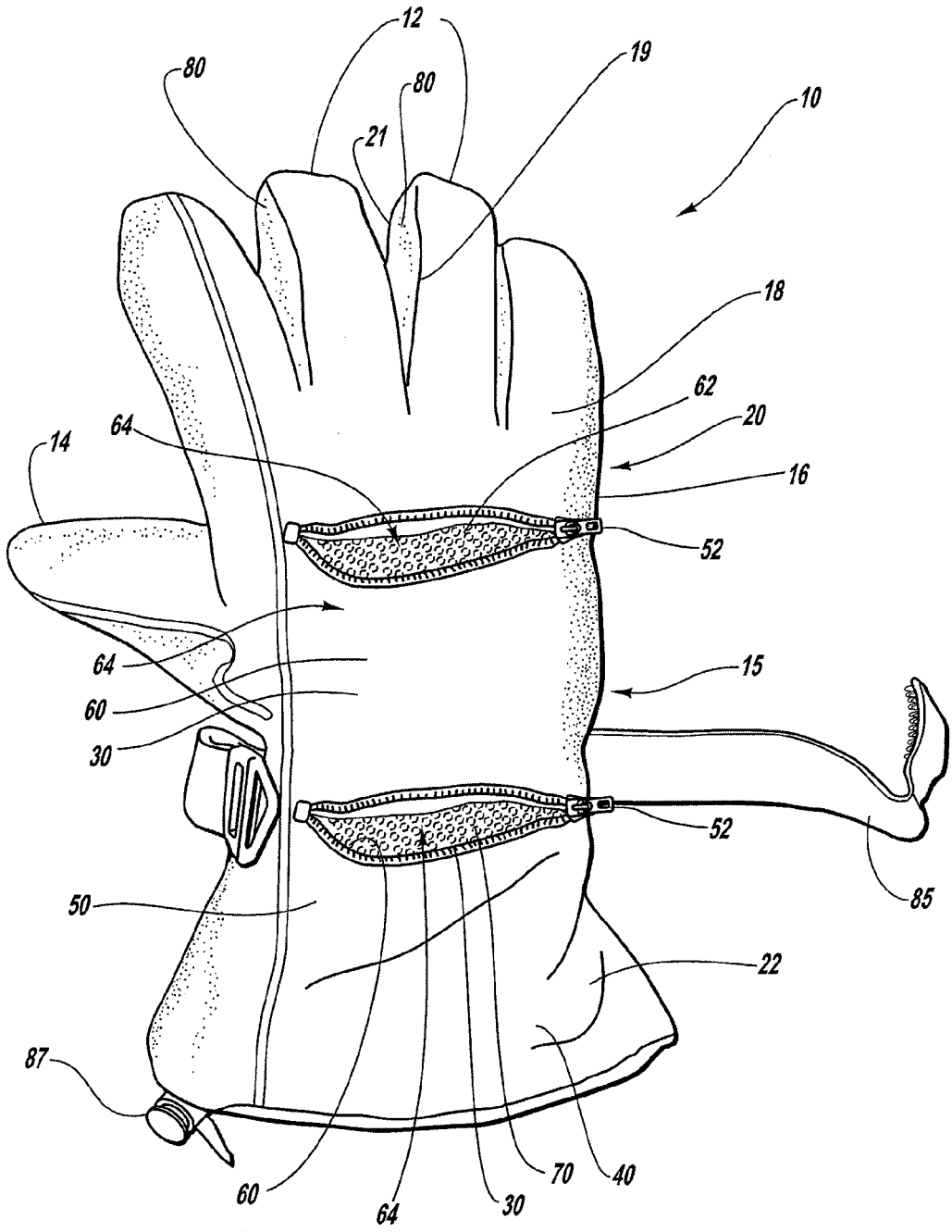
FIG. 7 is a perspective top view of an alternate configuration of a glove of the present invention.

With reference now to FIGS. 6 and 7, another preferred embodiment of the invention uses a second opening 62 in the glove 10 to create a cooling pathway 64 between the first opening 60 and the second opening 62. By opening both zippers 52, the resultant openings 60, 62 expose inner layer 30 and pathway 64 between the openings 60, 62. The size of the pathway 64 can vary as the user flexes and moves the hand and heat can escape through either opening 60, 62. In addition, air can pass through the cooling pathway, particularly as the user moves at high speeds or moves their hand within the glove, increasing the cooling effect.

The addition of a cooling pathway, in addition to the previously discussed removable insulator, greatly increases the number of temperature control options available to a user. With the second opening the pocket or pouch formed on the back of the hand can: have insulating barrier 100 or heating elements added in particularly cold weather; have no insulating barrier or heating elements added during moderate weather; or have the first and second openings opened to increase heat loss through the openings during warmer weather.

In FIG. 6, in one such dual opening embodiment the openings are arranged parallel to a length of the glove, the length of the glove defined as running from the tips of the fingers to the wrist. As a user flexes the fingers of the hand, the back portion 66 of the glove will tend to expand and contract increasing the flow of air through the glove. As another example of the invention, in FIG. 7 the dual openings are positioned perpendicular to the length of the glove such that air may tend to pass through the glove as the user travels at high speed or faces the wind. Of course, other opening configurations are within the scope of the invention and will be apparent to those skilled in the art in view of the disclosure herein.

Various other modes for carrying out the invention are contemplated as being within the scope of the following claims particularly pointing out and distinctly claiming the subject matter which is regarded as the invention.

What is claimed is:

1. A glove having an insulation pocket for removable insertion of an insulator, said glove comprising:

a glove body having a backhand portion formed from a first material;

said insulator for insulating the back of the hand, said insulator being formed from a heat insulating material; and pocket means formed under said backhand portion and sized to receive said insulator therein, said pocket means having:

a first opening in said backhand portion sized for removably positioning said insulator in said pocket means; and a second opening in said backhand portion spaced from said first opening with a cooling pathway therebetween, wherein said first opening and said second opening are each in communication with said cooling pathway and sized for the passage of cooling air therebetween and under said backhand portion when said insulator is removed.

2. The glove of claim 1, wherein opening said first opening and said second opening and removing said insulator permits the flow of air through said pocket means between said first opening and said second opening.

3. The glove of claim 1, wherein said first opening and said second opening are formed parallel to a length of the glove.

4. The glove of claim 1, wherein said first opening and said second opening are formed perpendicular to a length of the glove.

5. The glove of claim 1, wherein said first material is a single layer of heat insulating material.

6. The glove of claim 1, wherein said backhand portion has an upper surface which has an outer layer, wherein said glove includes an inner layer proximate to said outer layer which inner layer and outer layer are separable to define a space therein between, wherein said pocket means is positioned in said space.

7. The glove of claim 6, wherein a zipper is attached to said upper surface at said first opening, said zipper being operable between an open position in which said insulator may pass therethrough and a closed position to inhibit the movement of said insulator into and out of said pouch.

8. The glove of claim 7, wherein said pocket means is formed from a mesh material.

9. The glove of claim 8, wherein said outer layer is formed from said first material, said first material being a water resistant material and said inner layer is formed from a heat insulating material.

10. The glove of claim 1, wherein said insulator is formed from closed cell neoprene.

11. The glove of claim 10, wherein said backhand portion is formed from a water resistant heat insulating material.

12. A glove having an insulation pocket for removable insertion of an insulator, said glove comprising:

a glove body having a backhand portion which includes an upper surface and an outer layer formed from a first material, said glove body including an inner layer formed from a second material, said inner layer positioned relative to said outer layer and separable therefrom to define a space therein between, said upper surface having a first opening and a second opening spaced from said first opening formed therein;

said insulator formed from a heat insulating material for insertion into said space through said first opening; and a pouch formed from a third material different than said first material and said second material, said pouch in communication with said first opening and said second opening and secured to said upper surface proximate said first opening and said second opening, said pouch positioned relative to said backhand portion for receiving an insulator from said first opening; wherein said first opening and said second opening are sized for the passage of cooling air therebetween through said pouch and under said outer layer when said insulator is removed.

13. The glove of claim 12, wherein said pouch material is a mesh material secured to said outer layer proximate said first opening and said second opening.

14. The glove of claim 12, wherein said pouch is positioned to restrain said insulator proximate said backhand portion.

15. The glove of claim 12, wherein said first material is a water resistant material and said second material is a heat insulating material.

16. The glove of claim 15, wherein said third material is a flexible material.

17. The glove of claim 16, wherein said flexible material is a mesh material.

18. The glove of claim 12, further comprising a heat-generating layer positioned between said insulator and said inner layer within said pouch.

19. A glove having an insulation pocket for removable insertion of an insulator, said glove comprising:

a glove body having a backhand portion formed from a first material;

said insulator for insulating the back of the hand, said insulator being formed from a heat insulating material; and pocket means formed relative to said backhand portion for receiving said insulator, said pocket means having:

a first opening for removably positioning said insulator therein, said pocket means including a pouch formed from a second material different than said first material, said pouch being secured to said glove body and sized to receive said insulator; and a second opening, wherein opening said first opening and said second opening and removing said insulator permits increased cooling from the back of the hand, wherein said first opening and said second opening are formed parallel to a length of the glove.

20. A glove having an insulation pocket for removable insertion of an insulator, said glove comprising:

a glove body having a backhand portion formed from a first material;

said insulator for insulating the back of the hand, said insulator being formed from a heat insulating material; and pocket means formed relative to said backhand portion for receiving said insulator, said pocket means having:

a first opening for removably positioning said insulator therein, said pocket means including a pouch formed from a second material different than said first material, said pouch being secured to said glove body and sized to receive said insulator; and a second opening, wherein opening said first opening and said second opening and removing said insulator permits increased cooling from the back of the hand, wherein said first opening and said second opening are formed perpendicular to a length of the glove.

* * * * *